US006223808B1

(12) United States Patent
Tsunoda et al.

(10) Patent No.: US 6,223,808 B1
(45) Date of Patent: May 1, 2001

(54) SUPPORTING STRUCTURE FOR HEAT EXCHANGER

(75) Inventors: Tadashi Tsunoda; Toshiki Kawamura, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/341,683

(22) PCT Filed: Jan. 23, 1998

(86) PCT No.: PCT/JP98/00271

§ 371 Date: Sep. 24, 1999

§ 102(e) Date: Sep. 24, 1999

(87) PCT Pub. No.: WO98/33033

PCT Pub. Date: Jul. 30, 1998

(30) Foreign Application Priority Data

Jan. 27, 1997 (JP) ..... 9-12964

(51) Int. Cl.[7] ..... F28F 9/007
(52) U.S. Cl. ..... 165/82; 165/164; 165/162
(58) Field of Search ..... 165/81, 82, 162, 165/164

(56) References Cited

U.S. PATENT DOCUMENTS

| | | | | |
|---|---|---|---|---|
| 2,594,761 | * | 4/1952 | Fletcher et al. | 165/162 |
| 3,526,275 | * | 9/1970 | Vance et al. | 165/158 |
| 3,896,873 | * | 7/1975 | Wolowodiuk et al. | 165/76 |
| 3,907,457 | | 9/1975 | Nakamura et al. . | |
| 4,582,126 | * | 4/1986 | Corey | 165/82 |
| 4,702,310 | * | 10/1987 | McDonough | 165/154 |
| 4,921,680 | * | 5/1990 | Bonk et al. | 422/197 |
| 5,065,816 | * | 11/1991 | Darragh | 165/125 |

FOREIGN PATENT DOCUMENTS

| | | | | |
|---|---|---|---|---|
| 3615877 | * | 11/1987 | (DE) | 165/162 |
| 0 753 712 A2 | | 1/1997 | (EP) . | |
| 2 005 355 | | 4/1979 | (GB) . | |
| 48-54751 | | 7/1973 | (JP) . | |
| 52-16259 | | 5/1977 | (JP) . | |
| 58-55694 | | 4/1983 | (JP) . | |
| 60-32117 | | 7/1985 | (JP) . | |
| 5-506917 | | 10/1993 | (JP) . | |
| 6-72753 | | 9/1994 | (JP) . | |
| 10-122764 | | 5/1998 | (JP) . | |

* cited by examiner

*Primary Examiner*—Allen Flanigan
(74) *Attorney, Agent, or Firm*—Arent Fox Kintner Plotkin & Kahn, PLLC

(57) ABSTRACT

An annular-shaped heat exchanger 2 provided with a high-temperature fluid passage inlet 11 at one end in the axial direction and a low-temperature fluid passage inlet 15 at the other end in the axial direction is supported inside a cylindrical outer casing 9 via a heat exchanger supporting ring 36. The heat exchanger supporting ring 36 connecting a low-temperature section near the low temperature fluid passage inlet 15 of the heat exchanger 2 and a rear flange 33 of the outer casing 9 is formed by bending a plate member in a cross-sectionally step shape so that it can readily undergo elastic deformation to offset the thermal expansion of the heat exchanger 2. This ensures positive sealing between the high-temperature fluid passage inlet 11 and the low-temperature fluid passage inlet 15 of the heat exchanger 2 while minimizing the thermal stress occurring in the heat exchanger 2 and the outer casing 9. The heat exchanger supporting ring 36 also has a function of partitioning between a combustion gas passage inlet 11 and an air passage inlet 15.

3 Claims, 14 Drawing Sheets

SUPPORTING STRUCTURE FOR HEAT EXCHANGER

FIELD OF THE INVENTION

The present invention relates to a supporting structure for a heat exchanger for supporting, within a cylindrical casing, an annular-shaped heat exchanger having a high-temperature fluid passage inlet and a low-temperature fluid passage inlet at axially opposite ends thereof.

BACKGROUND ART

Such a heat exchanger is already known from Japanese Patent Application No. 8-275051 filed by the assignee of the present invention.

In general, the heat exchanger uses two or more types of fluids having different temperatures as mediums. For this reason, a difference in temperature is generated between members due to a difference in temperature between the fluids, and further, a difference in temperature is also generated between the stoppage and operation of the heat exchanger. Therefore, if the outer periphery of the heat exchanger is supported firmly in the casing, the following problems arise due to a difference in the amount of thermal expansion between the members.

When the heat exchanger is in a state having a temperature higher than that of the casing, there is a possibility that a thermal stress could be produced in the casing in the drawing direction to exert an adverse influence to the durability. On the other hand, when the heat exchanger is in a state having a temperature lower than that of the casing, there is a possibility that a thermal stress could be produced in the heat exchanger in the drawing direction to exert an adverse influence to the durability. Particularly, when the heat exchanger and the casing are formed from different materials, the above-described problems are further significant due to the thermal stress caused by a difference between the intrinsic thermal expansion coefficients of the materials.

DISCLOSURE OF THE INVENTION

The present invention has been accomplished with the above circumstances in view, and it is an object of the present invention to ensure that a reliable seal is provided between the high-temperature fluid passage inlet and the low-temperature fluid passage inlet in the heat exchanger, while maintaining the thermal stresses generated in the heat exchanger and the casing to the minimum.

To achieve the above object, according to a first aspect and feature of the present invention, there is provided a supporting structure for a heat exchanger for supporting an annular-shaped heat exchanger having a high-temperature fluid passage inlet at one of axially opposite ends thereof and a low-temperature fluid passage inlet at the other end thereof, within a cylindrical casing which is divided axially into portions bonded together through a pair of flanges, characterized in that an inner peripheral surface of one of the flanges and an outer peripheral surface of the heat exchanger are connected to each other by a heat exchanger supporting ring made of a resiliently deformable plate member, whereby the heat exchanger is supported in the casing, and a seal is provided between the high-temperature fluid passage inlet and the low-temperature fluid passage inlet.

With the above arrangement, the heat exchanger is supported in the casing by connecting the inner peripheral surface of one of the flanges in the casing and the outer peripheral surface of the heat exchanger to each other by the heat exchanger supporting ring made of the resiliently deformable plate member. Therefore, the difference in the amount of thermal expansion between the heat exchanger and the one flange can be absorbed by the resilient deformation of the heat exchanger supporting ring to prevent a looseness from being generated in the support of the heat exchanger, while alleviating the thermal stress. Moreover, a seal can be provided between the high-temperature fluid passage inlet and the low-temperature fluid passage inlet by the heat exchanger supporting ring.

According to a second aspect and feature of the present invention, in addition to the first feature, there is provided a supporting structure for a heat exchanger characterized in that the heat exchanger supporting ring includes a first ring portion bonded to the outer peripheral surface of the heat exchanger, a second ring portion formed at a diameter larger than that of the first ring portion and bonded to the inner peripheral surface of the one flange, and a connecting portion for connecting the first and second ring portions to each other.

With the above arrangement, the heat exchanger supporting ring includes a first ring portion bonded to the outer peripheral surface of the heat exchanger, a second ring portion formed at a diameter larger than that of the first ring portion and bonded to the inner peripheral surface of the one flange, and a connecting portion for connecting the first and second ring portions to each other. Therefore, when the temperature of the heat exchanger rises, the heat exchanger supporting ring is easily resiliently deformed to absorb a difference in the amount of thermal expansion between the heat exchanger and the flange.

According to a third aspect and feature of the present invention, there is provided a supporting structure for a heat exchanger for supporting an annular-shaped heat exchanger having a high-temperature fluid passage inlet at one of axially opposite ends thereof and a low-temperature fluid passage inlet at the other end thereof, within a cylindrical casing which is divided axially into portions bonded together through a pair of flanges, characterized in that a heat exchanger supporting ring fixed to an outer peripheral surface of the heat exchanger is fitted in a socket-and-spigot fashion to an inner peripheral surface of one of the flanges, and a seal member is disposed between the heat exchanger supporting ring and the other flange.

With the above arrangement, the heat exchanger supporting ring fixed to the outer peripheral surface of the heat exchanger is fitted in the socket-and-spigot fashion to the inner peripheral surface of one of the flanges. Therefore, when the heat exchanger and the heat exchanger supporting ring are thermally expanded, the heat exchanger supporting ring is brought into abutment against the one flange, whereby the thermal expansion of the heat exchanger can be absorbed by a clearance in the portion fitted in the socket-and-spigot fashion to prevent the generation of a looseness in the support of the heat exchanger, while alleviating the thermal stress. Moreover, since the seal member is disposed between the heat exchanger supporting ring and the other flange, a reliable seal can be provided between the high-temperature fluid passage inlet and the low-temperature fluid passage inlet.

According to a fourth aspect and feature of the present invention, in addition to the third feature, there is provided a supporting structure for a heat exchanger characterized in that a stopper is provided for preventing the slip-off of the socket-and-spigot type fitting.

With the above arrangement, since the stopper is provided for preventing the slip-off of the socket-and-spigot type fitting, it is possible to prevent the axial movement of the heat exchanger relative to the casing.

According to a fifth aspect and feature of the present invention, there is provided a supporting structure for a heat exchanger for supporting an annular-shaped heat exchanger having a high-temperature fluid passage inlet at one of axially opposite ends thereof and a low-temperature fluid passage inlet at the other end thereof, within a cylindrical casing which is divided axially into portions bonded together through a pair of flanges, characterized in that a heat exchanger supporting ring fixed to an outer peripheral surface of the heat exchanger is disposed coaxially on an inner peripheral surface of one of the flanges with a radial clearance left therebetween; a spring is disposed between the heat exchanger supporting ring and the one flange for biasing the heat exchanger supporting ring and the one flange in the direction to increase the clearance; and a seal member is disposed between the heat exchanger supporting ring and the other flange.

With the above arrangement, the heat exchanger supporting ring fixed to an outer peripheral surface of the heat exchanger is disposed coaxially on the inner peripheral surface of one of the flanges with a radial clearance left therebetween, and the spring is disposed between the heat exchanger supporting ring and the one flange for biasing the heat exchanger supporting ring and the one flange in the direction to increase the clearance. Therefore, the thermal expansion of the heat exchanger can be absorbed by the radial clearance to prevent the generation of a looseness in the support of the heat exchanger by the spring, while alleviating the thermal stress. Moreover, since the seal member is disposed between the heat exchanger supporting ring and the other flange, a reliable seal is provided between the high-temperature fluid passage inlet and the low-temperature fluid passage inlet.

According to a sixth aspect and feature of the present invention, in addition to any of the first to fifth features, there is provided a supporting structure for a heat exchanger characterized in that the heat exchanger supporting ring is mounted at a location nearer to the low-temperature fluid passage inlet than to the high-temperature fluid passage inlet.

With the above arrangement, since the heat exchanger supporting ring is mounted at the location near to the low-temperature fluid passage inlet which is at a relative low temperature, it is possible to avoid the generation of a thermal stress further effectively.

BRIEF DESCRIPTION OF THE DRAWINGS

FIGS. 1 to 12 show a first embodiment of the present invention, wherein

FIG. 1 is a side view of the entire arrangement of a gas turbine engine;

FIG. 2 is a sectional view taken along a line 2—2 in FIG. 1;

FIG. 3 is an enlarged sectional view taken along a line 3—3 in FIG. 2 (a sectional view of combustion gas passages);

FIG. 4 is an enlarged sectional view taken along a line 4—4 in FIG. 2 (a sectional view of air passages);

FIG. 5 is an enlarged sectional view taken along a line 5—5 in FIG. 3;

FIG. 6 is an enlarged view of a portion indicated by 6 in FIG. 5;

FIG. 7 is an enlarged sectional view taken along a line 7—7 in FIG. 3;

FIG. 8 is a developed view of a folding plate blank;

FIG. 9 is a perspective view of an essential portion of the heat exchanger;

FIG. 10 is a pattern view showing flows of a combustion gas and air;

BEST MODE FOR CARRYING OUT THE INVENTION

A first embodiment of the present invention will now be described with reference to FIGS. 1 to 12.

Figure 1:
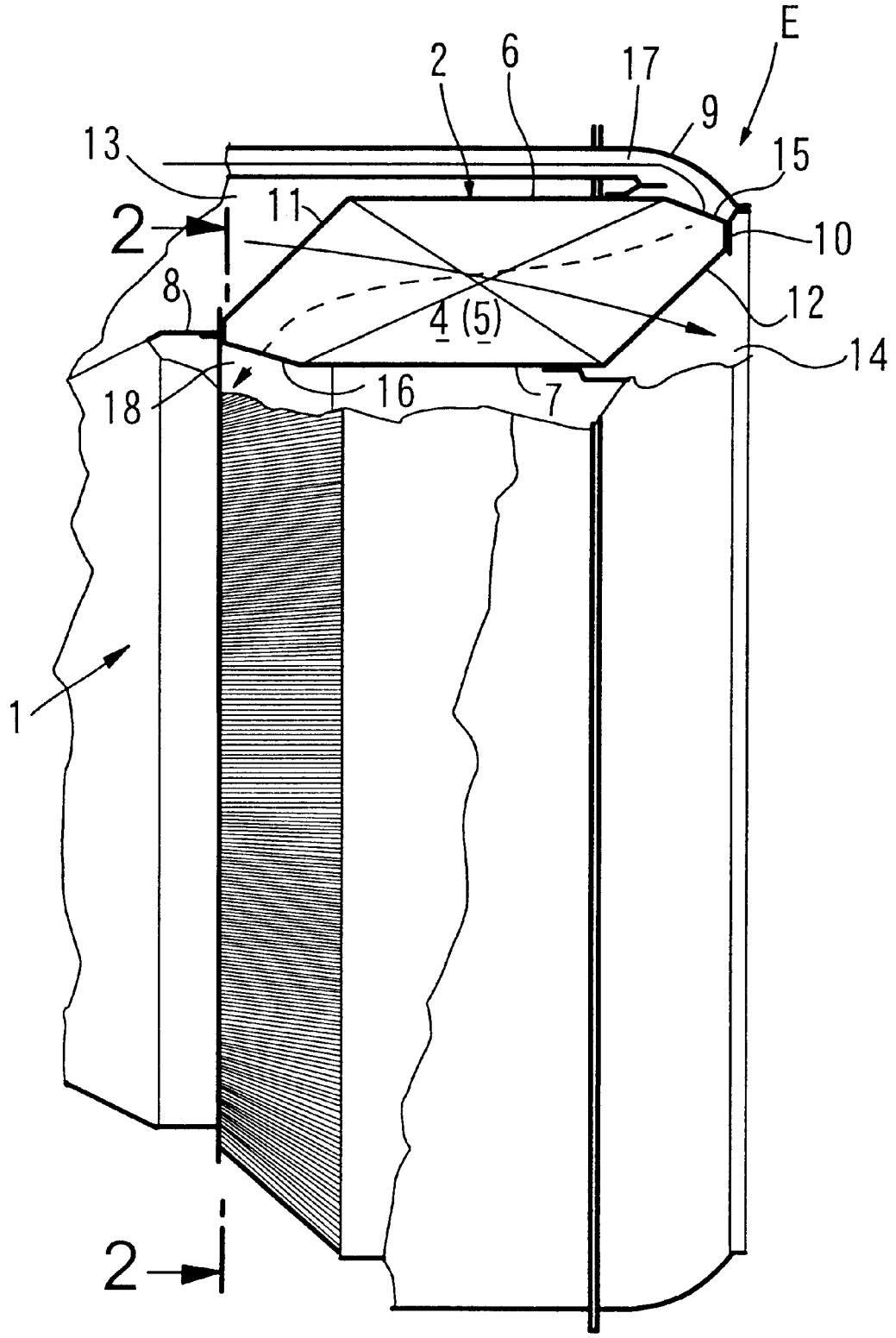
Figure 2:
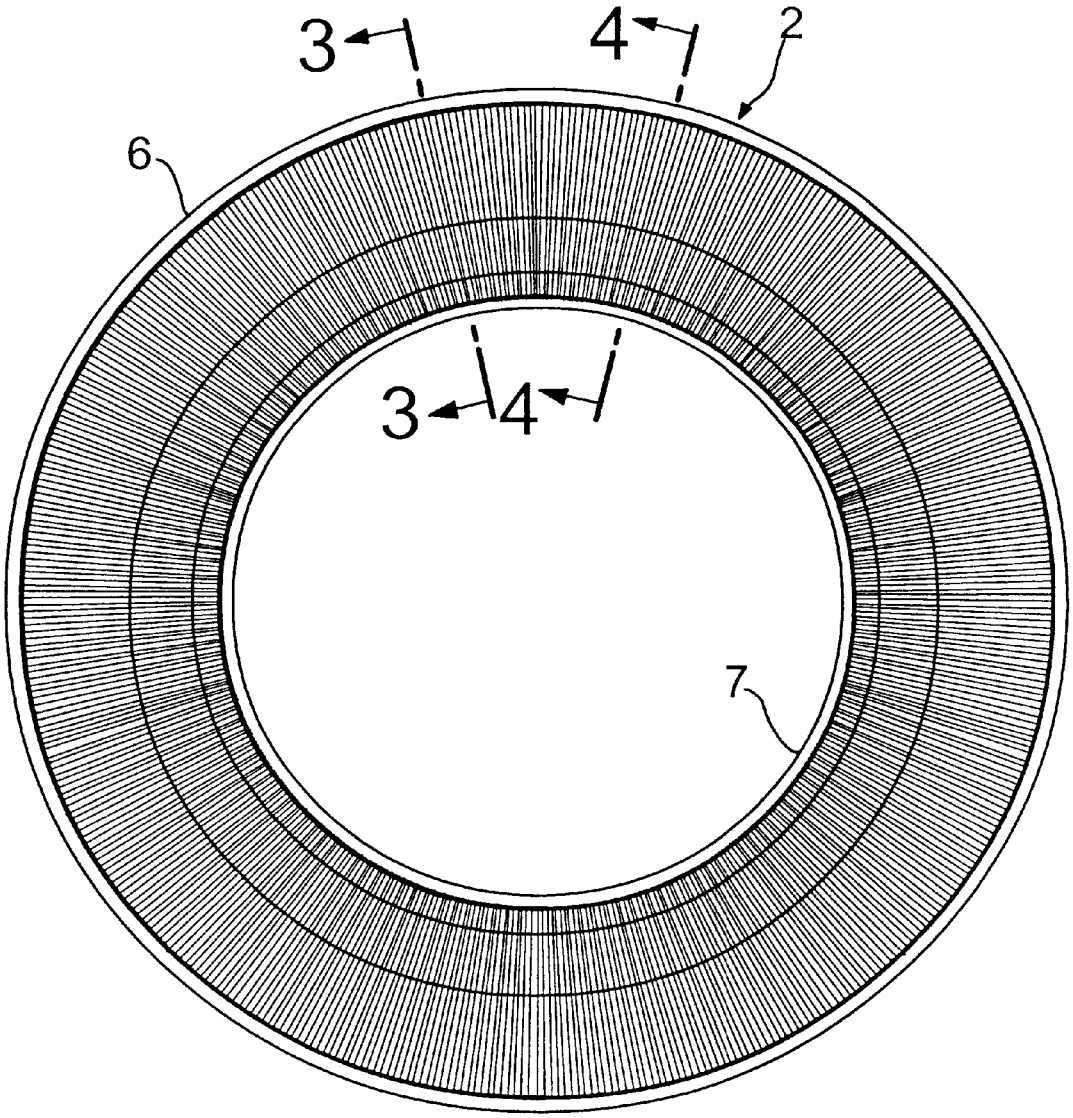

As shown in FIGS. 1 and 2, a gas turbine engine E includes an engine body 1 in which a combustor, a compressor, a turbine and the like (which are not shown) are accommodated. An annular heat exchanger 2 is disposed to surround an outer periphery of the engine body 1. Combustion gas passages 4 and air passages 5 are circumferentially alternately provided in the heat exchanger 2 (see FIG. 5), so that a combustion gas of a relative high temperature passed through turbine is passed through the combustion gas passages 4, and air of a relative low temperature compressed in the compressor is passed through the air passages 5. A section in FIG. 1 corresponds to the combustion gas passages 4, and the air passages 5 are defined adjacent this side and on the other side of the combustion gas passages 4.

The sectional shape of the heat exchanger 2 taken along an axis is an axially longer and radially shorter flat hexagonal shape. A radially outer peripheral surface of the heat exchanger 2 is closed by a larger-diameter cylindrical outer casing 6, and a radially inner peripheral surface of the heat exchanger 2 is closed by a smaller-diameter cylindrical inner casing 7. A front end side (a left side in FIG. 1) in the longitudinal section of the heat exchanger 2 is cut into an unequal-length angle shape, and an end plate 8 connected to an outer periphery of the engine body 1 is brazed to a portion corresponding to an apex of the angle shape. A rear end side (a right side in FIG. 1) in the section of the heat exchanger 2 is cut into an unequal-length angle shape, and an end plate 10 connected to an outer housing 9 is brazed to a portion corresponding to an apex of the angle shape.

Each of the combustion gas passages 4 in the heat exchanger 2 includes a combustion gas passage inlet 11 and a combustion gas passage outlet 12 at the left and upper portion and the right and lower portion of FIG. 1, respectively. A combustion gas introducing space (referred to as a combustion gas introducing duct) 13 defined along the outer periphery of the engine body 1 is connected at its downstream end to the combustion gas passage inlet 11. A combustion gas discharging space (referred to as a combustion gas discharging duct) 14 extending within the engine body 1 is connected at its upstream end to the combustion gas passage outlet 12.

Each of the air passages 5 in the heat exchanger 2 includes an air passage inlet 15 and an air passage outlet 16 at the right and upper portion and the left and lower portion of FIG. 1, respectively. An air introducing space (referred to as an air introducing duct) 17 defined along an inner periphery of the outer housing 9 is connected at its downstream end to the air passage inlet 15. An air discharging space (referred to as an air discharging duct) 18 extending within the engine body 1 is connected at its upstream end to the air passage outlet 16.

Figure 3:
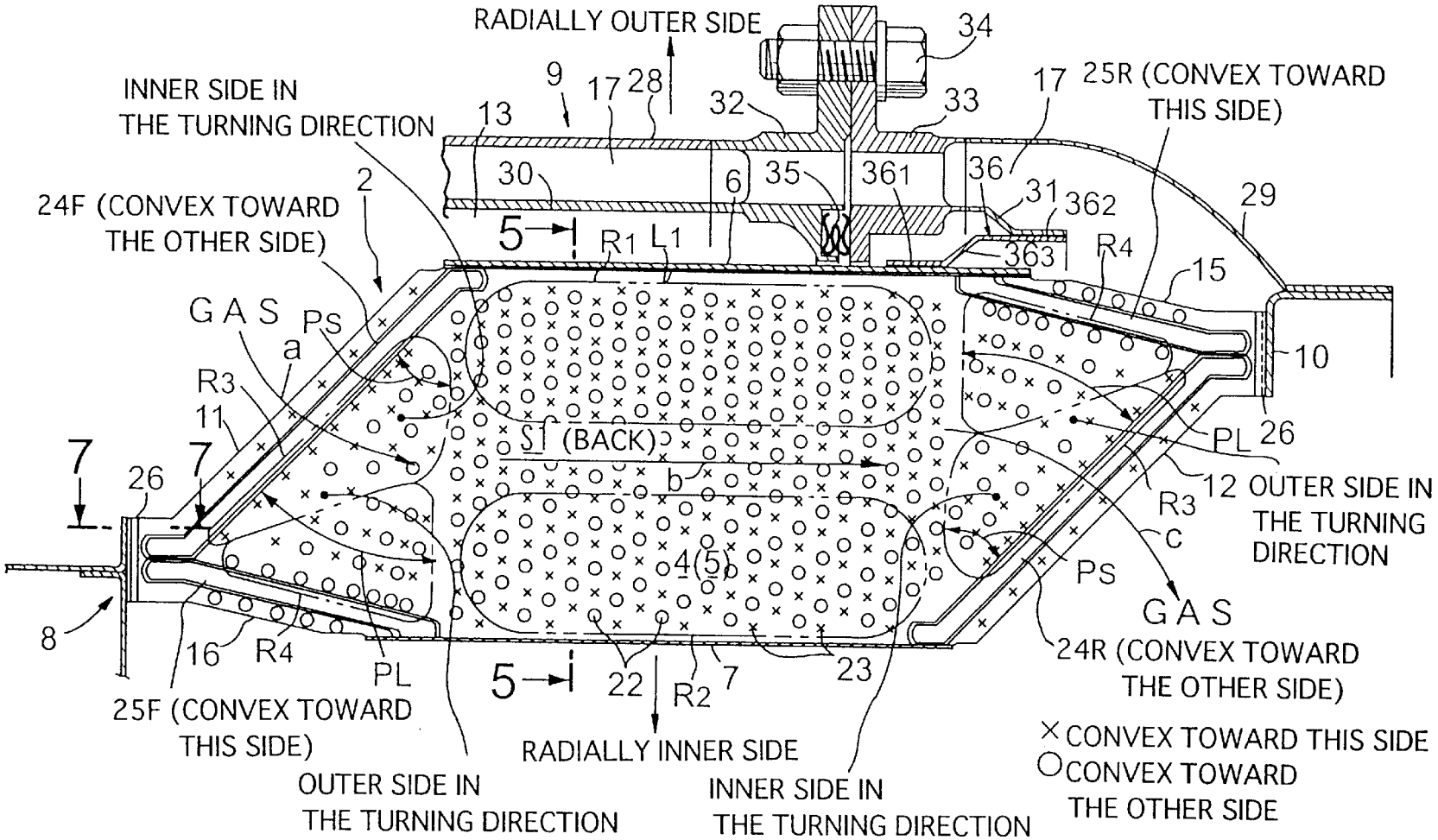
Figure 4:
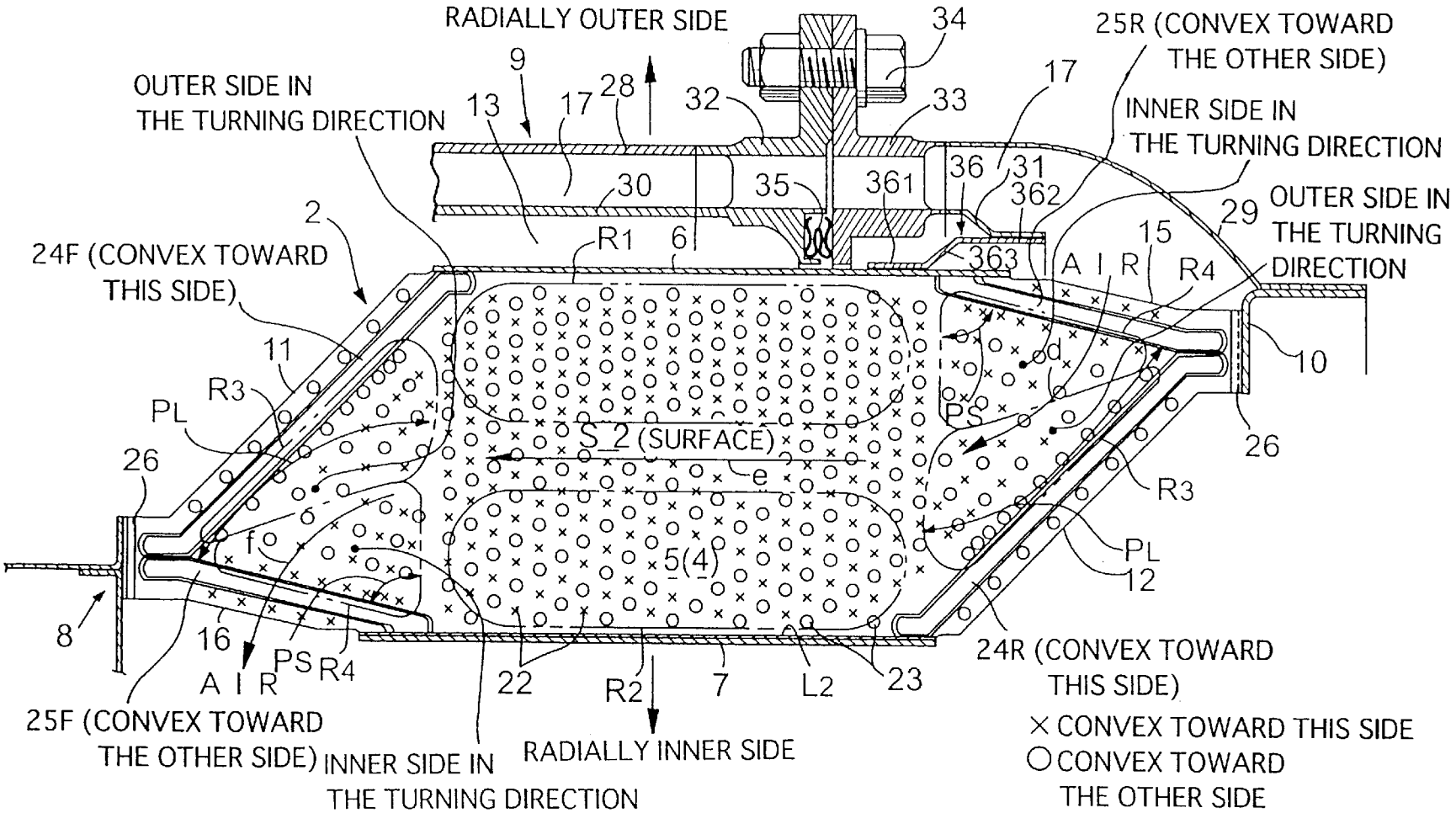
Figure 10:
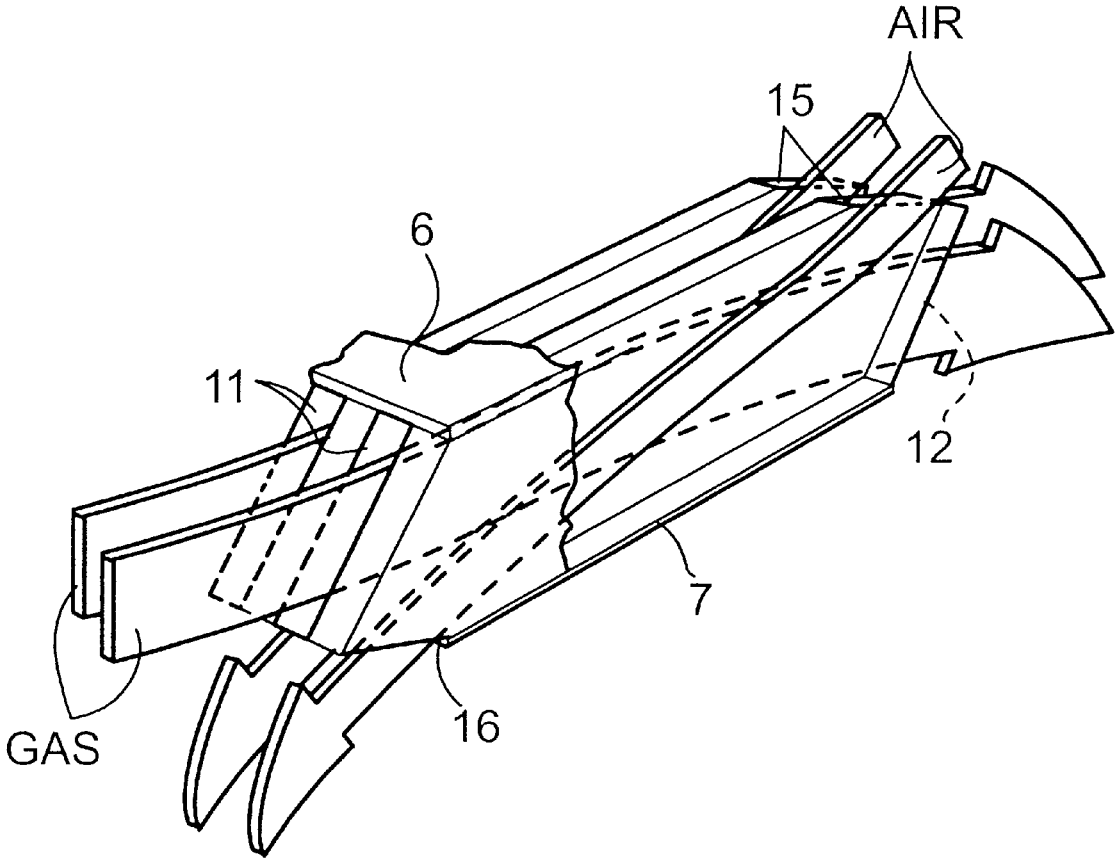

In this manner, the combustion gas and the air flow in opposite directions from each other and cross each other as shown in FIGS. 3, 4 and 10, whereby a counter flow and a so-called cross-flow are realized with a high heat-exchange efficiency. Thus, by allowing a high-temperature fluid and a low-temperature fluid to flow in opposite directions from each other, a large difference in temperature between the high-temperature fluid and the low-temperature fluid can be maintained over the entire length of the flow paths, thereby enhancing the heat-exchange efficiency.

The temperature of the combustion gas which has driven the turbine is about 600 to 700° C. in the combustion gas passage inlets 11. The combustion gas is cooled down to about 300 to 400° C. in the combustion gas passage outlets 12 by conducting a heat-exchange between the combustion gas and the air when the combustion gas passes through the combustion gas passages 4. On the other hand, the temperature of the air compressed by the compressor is about 200 to 300° C. in the air passage inlets 15. The air is heated up to about 500 to 600° C in the air passage outlets 16 by conducting a heat-exchange between the air and the combustion gas, which occurs when the air passes through the air passages 5.

The structure of the heat exchanger 2 will be described below with reference to FIGS. 3 to 9.

Figure 8:
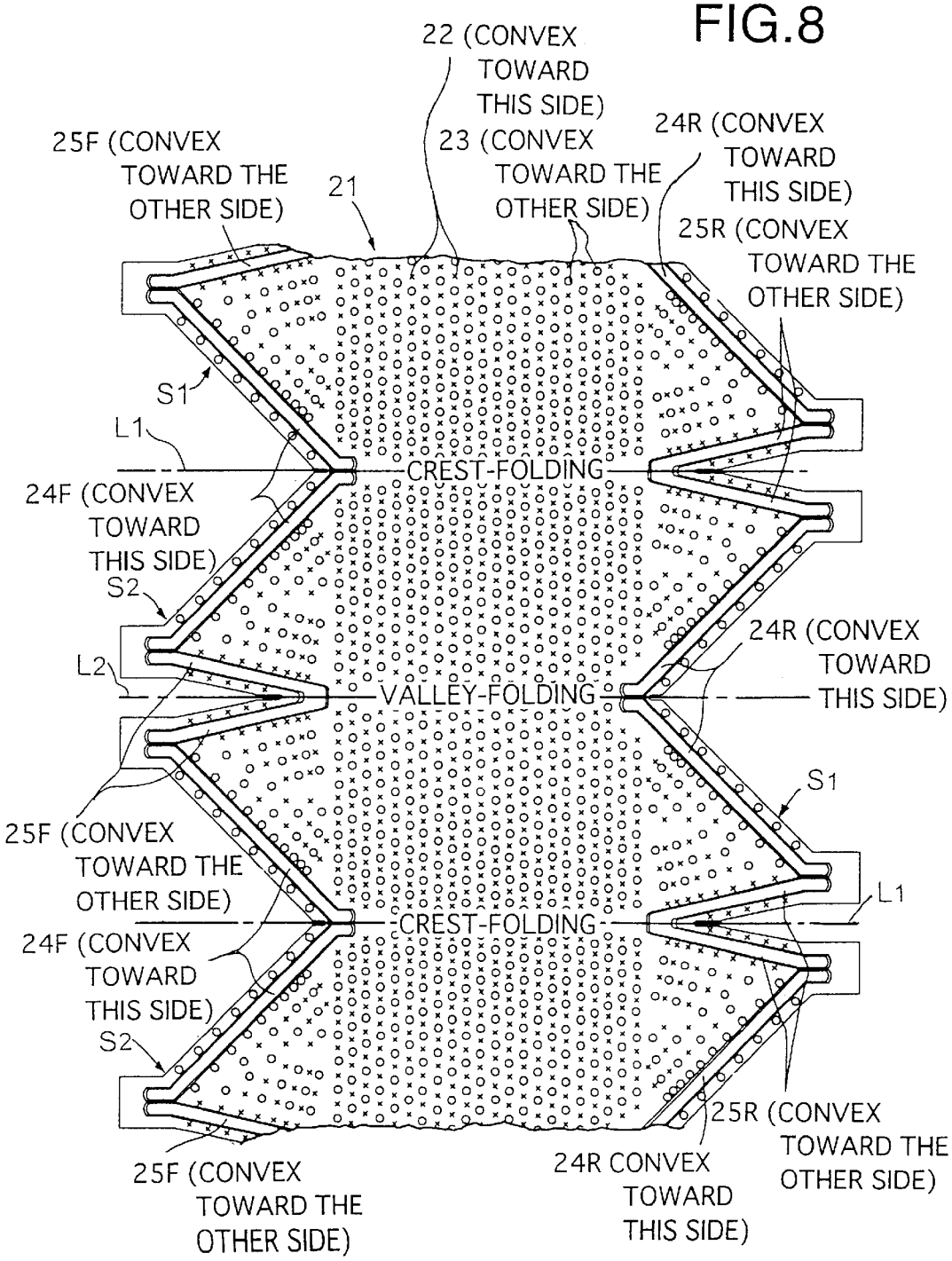

As shown in FIGS. 3, 4 and 8, a body portion of the heat exchanger 2 is made from a folding plate blank 21 produced by previously cutting a thin metal plate such as a stainless steel into a predetermined shape and then forming an irregularity on a surface of the cut plate by pressing. The folding plate blank 21 is comprised of first heat-transfer plates S1 and second heat-transfer plates S2 disposed alternately, and is folded into a zigzag fashion along crest-folding lines $L_1$ and valley-folding lines $L_2$. The term "crest-folding" means folding into a convex toward this side or a closer side from the drawing sheet surface, and the term "valley-folding" means folding into a convex toward the other side or a far side from the drawing sheet surface. Each of the crest-folding lines $L_1$ and the valley-folding lines $L_2$ is not a simple straight line, but actually comprises an arcuate folding line for the purpose of forming a predetermined space between each of the first heat-transfer plates S1 and each of the second heat-transfer plates S2.

A large number of first projections 22 and a large number of second projections 23, which are disposed at unequal distances, are formed on each of the first and second heat-transfer plates S1 and S2 by pressing. The first projections 22 indicated by a mark X in FIG. 8 protrude toward this side on the drawing sheet surface of FIG. 8, and the second projections 23 indicated by a mark O in FIG. 8 protrude toward the other side on the drawing sheet surface of FIG. 8.

First projection stripes $\mathbf{24}_F$ and second projection stripes $\mathbf{25}_F$ are formed by pressing at those front and rear ends of the first and second heat-transfer plates S1 and S2 which are cut into the angle shape. The first projection stripes $\mathbf{24}_F$ protrude toward this side on the drawing sheet surface of FIG. 8, and the second projection stripes $\mathbf{25}_F$ protrude toward the other side on the drawing sheet surface of FIG. 8. In any of the first and second heat-transfer plates S1 and S2, a pair of the front and rear first projection stripes $\mathbf{24}_F$, $\mathbf{24}_R$ are disposed at diagonal positions, and a pair of the front and rear second projection stripes $\mathbf{25}_F$, $\mathbf{25}_R$ are disposed at other diagonal positions.

The first projections 22, the second projections 23, the first projection stripes $\mathbf{24}_F$, $\mathbf{24}_R$ and the second projection stripes $\mathbf{25}_F$, $\mathbf{25}_R$ of the first heat-transfer plate S1 shown in FIG. 3 are in an opposite recess-projection relationship with respect to that in the first heat-transfer plate S1 shown in FIG. 8. This is because FIG. 3 shows a state in which the first heat-transfer plate S1 is viewed from the back side.

Figure 5:
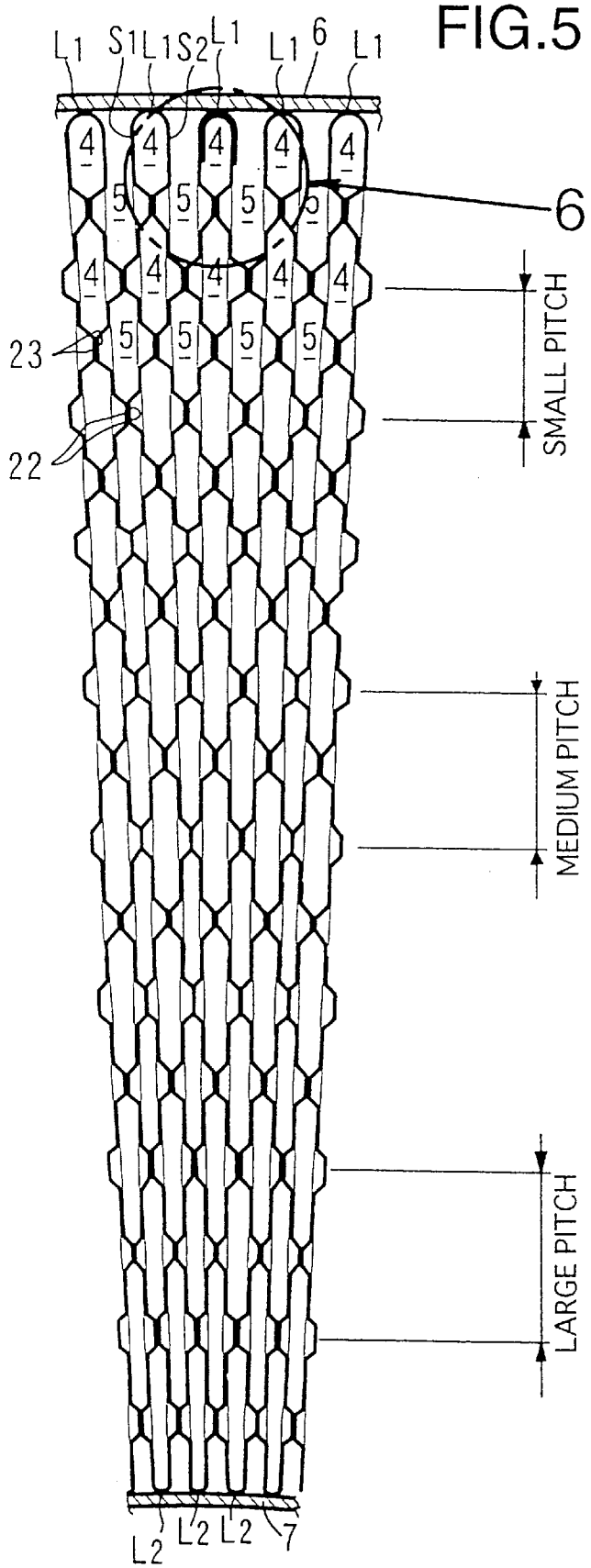

As can be seen from FIGS. 5 and 8, when the first and second heat-transfer plates S1 and S2 of the folding plate blank 21 are folded along the crest-folding lines $L_1$ to form the combustion gas passages 4 between both the heat-transfer plates S1 and S2, tip ends of the second projections 23 of the first heat-transfer plate S1 and tip ends of the second projections 23 of the second heat-transfer plate S2 are brought into abutment against each other and brazed to each other. In addition, the second projection stripes $\mathbf{25}_F$, $\mathbf{25}_R$ of the first heat-transfer plate S1 and the second projection stripes $\mathbf{25}_F$, $\mathbf{25}_R$ of the second heat-transfer plate S2 are brought into abutment against each other and brazed to each other. Thus, a left lower portion and a right upper portion of the combustion gas passage 4 shown in FIG. 3 are closed, and each of the first projection stripes $\mathbf{24}_F$, $\mathbf{24}_R$ of the first heat-transfer plate S1 and each of the first projection stripes $\mathbf{24}_F$, $\mathbf{24}_R$ of the second heat-transfer plate S2 are opposed to each other with a gap left therebetween. Further, the combustion gas passage inlet 11 and the combustion gas passage outlet 12 are defined in a left, upper portion and a right, lower portion of the combustion gas passage 4 shown in FIG. 3, respectively.

When the first heat-transfer plates S1 and the second heat-transfer plates S2 of the folding plate blank 21 are folded along the valley-folding line $L_2$ to form the air passages 5 between both the heat-transfer plates S1 and S2, the tip ends of the first projections 22 of the first heat-transfer plate S1 and the tip ends of the first projections 22 of the second heat-transfer plate S2 are brought into abutment against each other and brazed to each other. In addition, the first projection stripes $\mathbf{24}_F$, $\mathbf{24}_R$ of the first heat-transfer plate S1 and the first projection stripes $\mathbf{24}_F$, $\mathbf{24}_R$ of the second heat-transfer plate S2 are brought into abutment against each other and brazed to each other. Thus, a left upper portion and a right lower portion of the air passage 5 shown in FIG. 4 are closed, and each of the second projection stripes $\mathbf{25}_F$, $\mathbf{25}_R$ of the first heat-transfer plate S1 and each of the second projection stripes $\mathbf{25}_F$, $\mathbf{25}_R$ of the second heat-transfer plate S2 are opposed to each other with a gap left therebetween. Further, the air passage inlet 15 and the air passage outlet 16 are defined at a right upper portion and a left lower portion of the air passage 5 shown in FIG. 4, respectively.

Each of the first and second projections 22 and 23 has a substantially truncated conical shape, and the tip ends of the first and second projections 22 and 23 are in surface contact with each other to enhance the brazing strength. Each of the first and second projection stripes $\mathbf{24}_F$, $\mathbf{24}_R$ and $\mathbf{25}_F$, $\mathbf{25}_R$ has also a substantially trapezoidal section, and the tip ends of the first and second projection stripes $\mathbf{24}_F$, $\mathbf{24}_R$ and $\mathbf{25}_F$, $\mathbf{25}_R$ are also in surface contact with each other to enhance the brazing strength.

As can be seen from FIG. 5, radially inner peripheral portions of the air passages 5 are automatically closed, because they correspond to the folded portion (the valley-folding line $L_2$) of the folding plate blank 21, but radially outer peripheral portions of the air passages 5 are opened, and such opening portions are closed by brazing to the outer casing 6. On the other hand, radially outer peripheral portions of the combustion gas passages 4 are automatically closed, because they correspond to the folded portion (the crest-folding line $L_1$) of the folding plate blank 21, but radially inner peripheral portions of the combustion gas passages 4 are opened, and such opening portions are closed by brazing to the inner casing 7.

When the folding plate blank 21 is folded in the zigzag fashion, the adjacent crest-folding lines $L_1$ cannot be brought into direct contact with each other, but the distance between the crest-folding lines $L_1$ is maintained constant by the contact of the first projections 22 to each other. In addition, the adjacent valley-folding lines $L_2$ cannot be brought into direct contact with each other, but the distance between the valley-folding lines $L_2$ is maintained constant by the contact of the second projections 23 to each other.

When the folding plate blank 21 is folded in the zigzag fashion to produce the body portion of the heat exchanger 2, the first and second heat-transfer plates S1 and S2 are disposed radiately from the center of the heat exchanger 2. Therefore, the distance between the adjacent first and second heat-transfer plates S1 and S2 assumes the maximum in the radially outer peripheral portion which is in contact with the outer casing 6, and the minimum in the radially inner peripheral portion which is in contact with the inner casing 7. For this reason, the heights of the first projections 22, the second projections 23, the first projection stripes $\mathbf{24}_F$, $\mathbf{24}_R$ and the second projection stripes $\mathbf{25}_F$, $\mathbf{25}_R$ are gradually increased outwards from the radially inner side, whereby the first and second heat-transfer plates S1 and S2 can be disposed exactly radiately (see FIG. 5).

By employing the above-described structure of the radiately folded plates, the outer casing 6 and the inner casing 7 can be positioned concentrically, and the axial symmetry of the heat exchanger 2 can be maintained accurately.

Figure 7:
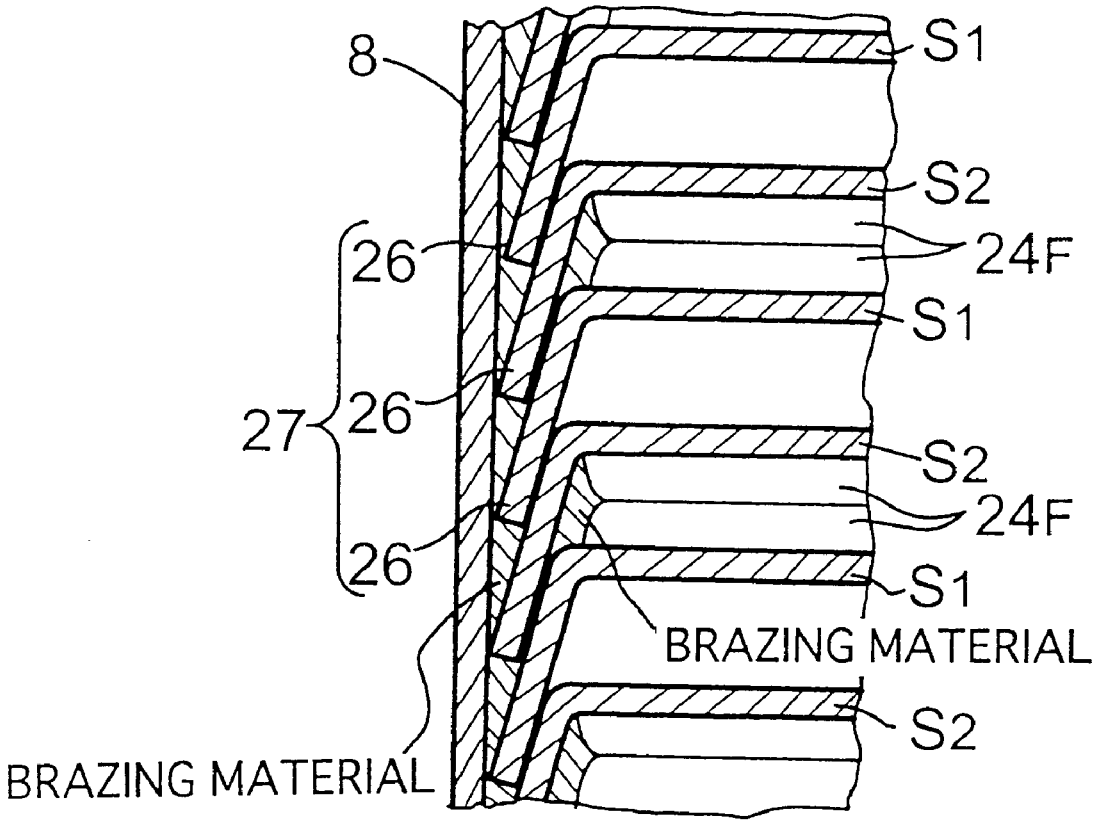
Figure 9:
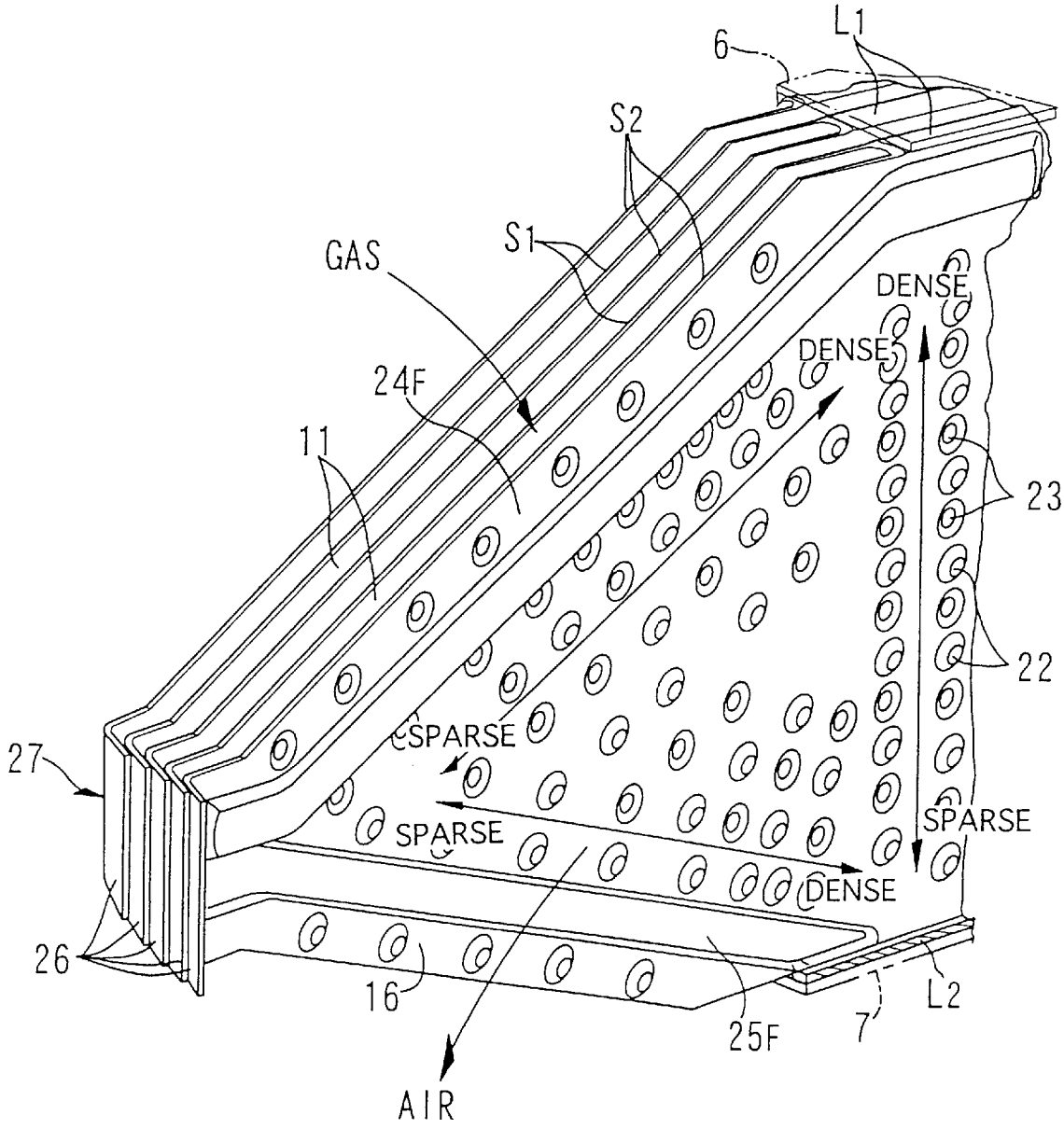

As can be seen from FIGS. 7 and 9, rectangular small piece-shaped flange portions 26 are formed by folding, apexes of front and rear ends of the first and second heat-transfer plates S1 and S2 cut into the angle shape, at an angle slightly smaller than 90° in the circumferential direction of the heat exchanger 2. When the folding plate blank 21 is folded in the zigzag fashion, a portion of each of the flanges 26 of the first and second heat-transfer plates S1 and S2 is superposed on and brazed in a surface contact state to a portion of the adjacent flange portion 26, thereby forming an annular bonding flange 27 as a whole. The bonding flange 27 is bonded by brazing to the front and rear end plates 8 and 10.

At this time, the front surface of the bonding flange 27 is of a stepped configuration, and a slight gap is defined between the bonding flange 27 and each of the end plates 8 and 10, but the gap Is closed by a brazing material (see FIG. 7). The flange portions 26 are folded in the vicinity of the tip ends of the first projection stripes $\mathbf{24}_F$ and $\mathbf{24}_R$ and the second projection stripes $\mathbf{25}_F$ and $\mathbf{25}_R$ formed on the first and second heat-transfer plates S1 and S2. When the folding plate blank 21 has been folded along the crest-folding line $L_1$ and the valley-folding line $L_2$, slight gaps are also defined between the tip ends of the first projection stripes $\mathbf{24}_F$ and $\mathbf{24}_R$ and the second projection stripes $\mathbf{25}_F$ and $\mathbf{25}_R$ and the flange portions 26, but the gaps are closed by the brazing material (see FIG. 7).

If an attempt is made to cut the apex portions of angle shapes of the first and second heat-transfer plates S1 and S2 into flat, and braze the end plates 8 and 10 to end surf aces resulting from such cutting, it is necessary to first fold the folding plate blank 21 and braze the first projections 22 and the second projections 23 as well as the first projection stripes $\mathbf{24}_F$ and $\mathbf{24}_R$ and the second projection stripes $\mathbf{25}_F$ and $\mathbf{25}_R$ of the first and second heat-transfer plates S1 and S2 to each other, and then subject the apex portions to a precise cutting treatment for brazing to the end plates 8 and 10. In this case, the two brazing steps are required, resulting in not only an increased number of steps but also an increased cost because of a high processing precision required for the cut surfaces. Moreover, it is difficult to provide a strength sufficient for brazing of the cut surfaces having a small area. However, by brazing the flange portions 26 formed by the folding, the brazing of the first projections 22 and the second projections 23 as well as the first projection stripes $\mathbf{24}_F$ and $\mathbf{24}_R$ and the second projection stripes $\mathbf{25}_F$ and $\mathbf{25}_R$ and the brazing of the flange portions 26 can be accomplished in a continuous flow, and further, the precise cutting treatment of the apex portions of the angle shapes is not required. Moreover, the flange portions 26 in surface contact with one another are brazed together, leading to remarkably increased brazing strength. Further, the flange portions themselves form the bonding flange 27, which can contribute to a reduction in number of parts.

By folding the folding plate blank 21 radiately and in the zigzag fashion to form the first and second heat-transfer plates S1 and S2 continuously, the number of parts and the number of points to be brazed can be reduced remarkably, and moreover, the dimensional precision of the completed article can be enhanced, as compared with the case where a large number of first heat-transfer plates S1 individually independent from one another and a large number of second heat-transfer plates S2 individually independent from one another are brazed alternately.

Figure 6:
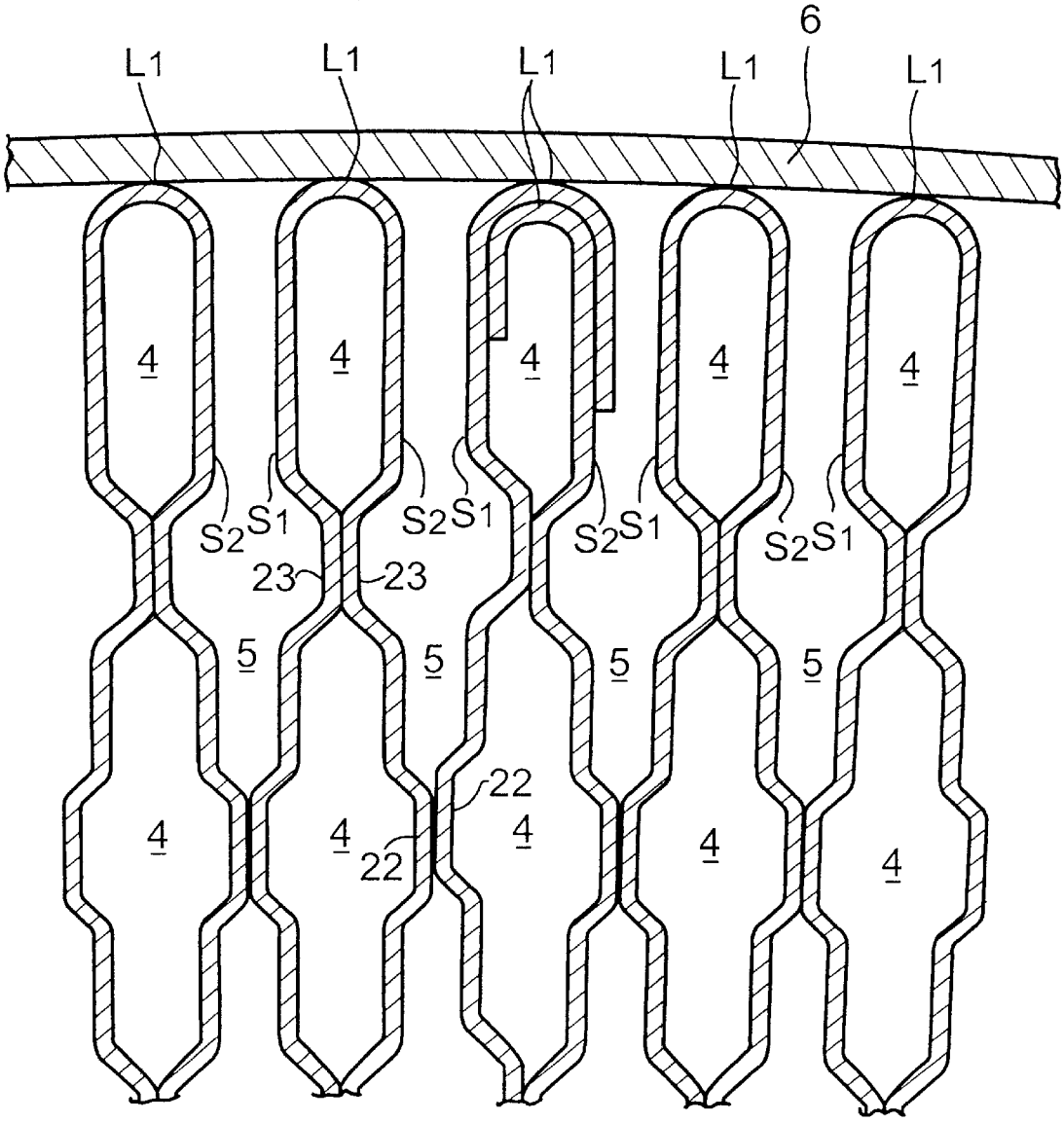

As can be seen from FIGS. 5 and 6, when the single folding plate blank 21 formed into a band shape is folded in a zigzag fashion to form the body portion of the heat exchanger 2, opposite ends of the folding plate blank 21 are integrally bonded to each other at a radially outer peripheral portion of the heat exchanger 2. Therefore, end edges of the first and second heat-transfer plates S1 and S2 adjoining each other with the bonded portion interposed therebetween are cut into a J-shape in the vicinity of the crest-folding line $L_1$, and for example, an outer periphery of the J-shaped cut portion of the second heat-transfer plate S2 is fitted to and brazed to an inner periphery of the J-shaped cut portion of the first heat-transfer plate S1. Since the J-shaped cut portions of the first and second heat-transfer plates S1 and S2 are fitted to each other, the J-shaped cut portion of the outer first heat-transfer plate S1 is forced to be expanded, while the J-shaped cut portion of the inner second heat-transfer plate S2 is forced to be contracted. Further, the inner second heat-transfer plate S2 is compressed inwards radially of the heat exchanger 2.

By employing the above-described structure, a special bonding member for bonding the opposite ends of the folding plate blank 21 to each other is not required, and a special processing such as changing the shape of the folding plate blank 21 is not required, either. Therefore, the number of parts and the processing cost are reduced, and an increase in heat mass in the bonded zone is avoided. Moreover, a dead space which is not the combustion gas passages 4 nor the air passages 5 is not created and hence, the increase in flow path resistance is maintained to the minimum, and there is not a possibility that the heat exchange efficiency may be reduced. Further, the bonded zone of the J-shaped cut portions of the first and second heat-transfer plates S1 and S2 is deformed and hence, a very small gap is liable to be produced. However, only the bonded zone may be the minimum, one by forming the body portion of the heat exchanger 2 by the single folding plate blank 21, and the leakage of the fluid can be suppressed to the minimum. Additionally, when the single folding plate blank 21 is folded in the zigzag fashion to form the body portion of the annular heat exchanger 2, if the numbers of the first and second heat-transfer plates S1 and S2 integrally connected to each other are not suitable, the circumferential pitch between the adjacent first and second heat-transfer plates S1 and S2 is inappropriate and moreover, there is a possibility that the tip ends of the first and second projection 22 and 23 may be separated or crushed. However, the circumferential pitch can be finely regulated easily only by changing the cutting position of the folding plate blank 21 to properly change the numbers of the first and second heat-transfer plates S1 and S2 integrally connected to each other.

During operation of the gas turbine engine E, the pressure in the combustion gas passages 4 is relatively low, and the pressure in the air passages 5 is relatively high. For this reason, a flexural load is applied to the first and second heat-transfer plates S1 and S2 due to a difference between the pressures, but a sufficient rigidity capable of withstanding such load can be obtained by virtue of the first and second projections 22 and 23 which have been brought into abutment against each other and brazed with each other.

In addition, the surface areas of the first and second heat-transfer plates S1 and S2 (i.e., the surface areas of the combustion gas passages 4 and the air passages 5) are increased by virtue of the first and second projections 22 and 23. Moreover, the flows of the combustion gas and the air are agitated and hence, the heat exchange efficiency can be enhanced.

The unit amount $N_{tu}$ of heat transfer representing the amount of heat transferred between the combustion gas passages 4 and the air passages 5 is given by the following equation (1):

$$N_{tu}=(K\times A)/[C\times(dm/dt)] \quad (1)$$

In the above equation (1), K is an overall heat transfer coefficient of the first and second heat-transfer plates S1 and S2; A is an area (a heat-transfer area) of the first and second heat-transfer plates S1 and S2; C is a specific heat of a fluid; and dm/dt is a mass flow rate of the fluid flowing in the heat transfer area. Each of the heat transfer area A and the specific heat C is a constant, but each of the overall heat transfer coefficient K and the mass flow rate dm/dt is a function of a pitch P (see FIG. 5) between the adjacent first projections 22 or between the adjacent second projections 23.

When the unit amount $N_{tu}$ of heat transfer is varied in the radial directions of the first and second heat-transfer plates S1 and S2, the distribution of temperature of the first and second heat-transfer plates S1 and S2 is non-uniformed radially, resulting in a reduced heat exchange efficiency, and moreover, the first and second heat-transfer plates S1 and S2 are non-uniformly, thermally expanded radially to generate undesirable thermal stress. Therefore, if the pitch P of radial arrangement of the first and second projections 22 and 23 is set suitably, so that the unit amount $N_{tu}$ of heat transfer is constant in radially various sites of the first and second heat-transfer plates S1 and S2, the above problems can be overcome.

Figure 11A:
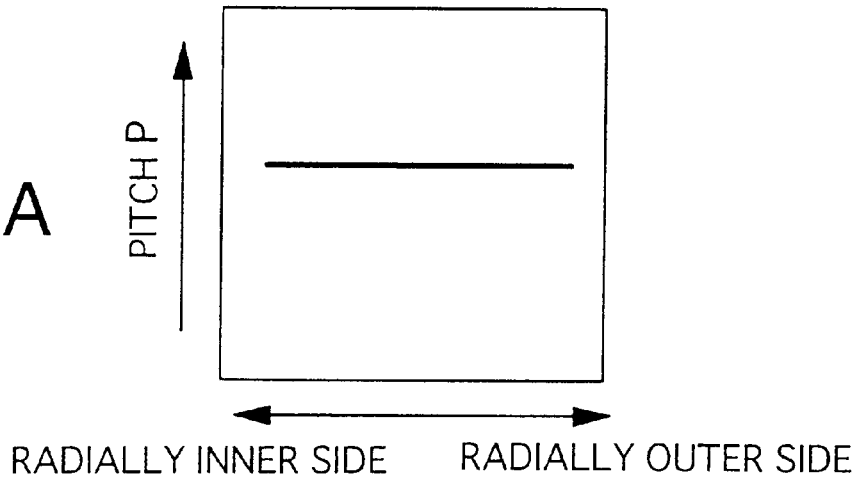
FIGS. 11A to 11C are graphs for explaining the operation when the pitch between projections is uniform.
Figure 11B:
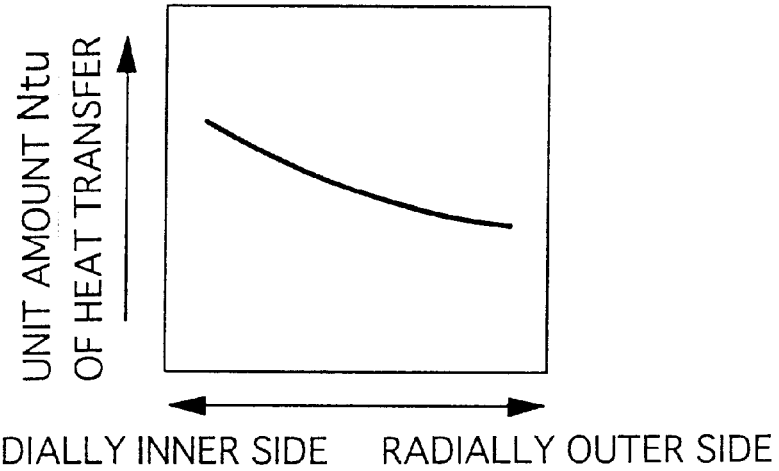
Figure 11C:
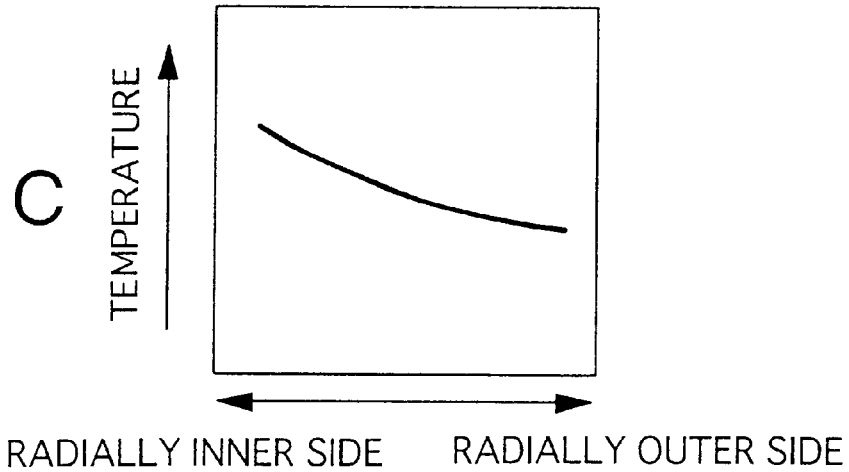
Figure 12A:
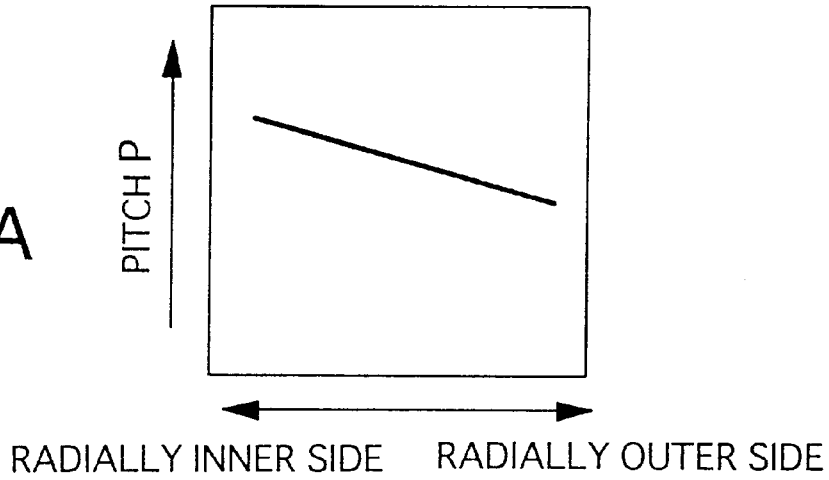
FIGS. 12A to 12C are graphs for explaining the operation when the pitch between projections is non-uniform.
Figure 12B:
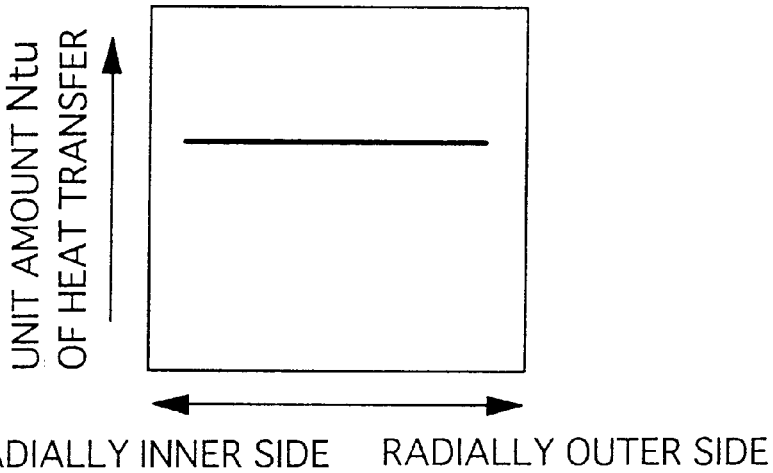
Figure 12C:
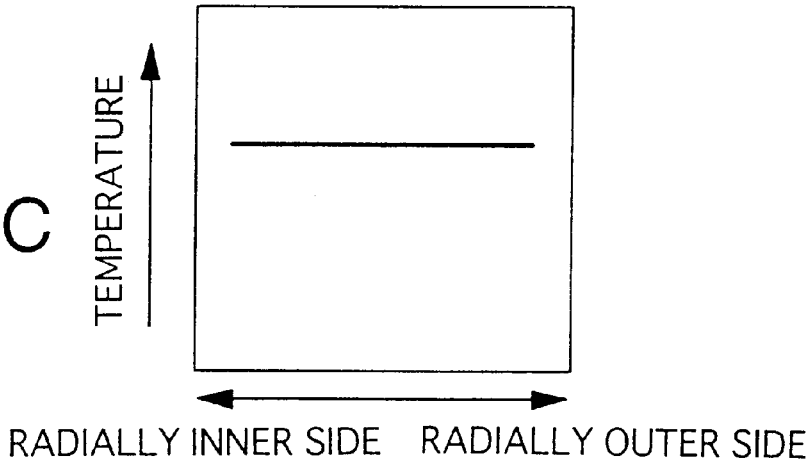

When the pitch P is set constant in the radial directions of the heat exchanger 2, as shown in FIG. 11A, the unit amount $N_{tu}$ of heat transfer is larger at the radially inner portion and smaller at the radially outer portion, as shown in FIG. 11B. Therefore, the distribution of temperature of the first and second heat-transfer plates S1 and S2 is also higher at the radially inner portion and lower at the radially outer portion, as shown in FIG. 11C. On the other hand, if the pitch P is set so that it is larger in the radially inner portion of the heat exchanger 2 and smaller in the radially outer portion of the heat exchanger 2, as shown in FIG. 12A, the unit amount $N_{tu}$ of heat transfer and the distribution of temperature can be made substantially constant in the radial directions, as shown in FIGS. 12B and 12C.

As can be seen from FIGS. 3 to 5, in the heat exchanger 2 according to this embodiment, a region $R_1$ having a small pitch P of radial arrangement of the first and second projections 22 and 23 is provided in the radially outer portions of the axially intermediate portions of the first and second heat-transfer plates S1 and S2 (namely, portions other than the angle-shaped portions at the axially opposite ends), and a region $R_2$ having a large pitch P of radial arrangement of the first and second projections 22 and 23 is provided in the radially inner portion. Thus, the unit number $N_{tu}$ of heat transfer can be made substantially constant over the entire region of the axially intermediate portions of the first and second heat-transfer plates S1 and S2, and it is possible to enhance the heat exchange efficiency and to alleviate the thermal stress.

If the entire shape of the heat exchanger and the shapes of the first and second projections 22 and 23 are varied, the overall heat transfer coefficient K and the mass flow rate dm/dt are also varied and hence, the suitable arrangement of pitches P is also different from that in the present embodiment. Therefore, in addition to a case where the pitch P is gradually decreased radially outwards as in the present embodiment, the pitch P may be gradually increased radially outwards in some cases. However, if the arrangement of pitches P is determined such that the above-described equation (1) is established, the operational effect can be obtained irrespective of the entire shape of the heat exchanger and the shapes of the first and second projections 22 and 23.

As can be seen from FIGS. 3 and 4, in the axially intermediate portions of the first and second heat-transfer plates S1 and S2, the adjacent first projections 22 or the adjacent second projections 23 are not arranged in a row in the axial direction of the heat exchanger 2 (in the direction of flowing of the combustion gas and the air), but are arranged so as to be inclined at a predetermined angle with respect to the axial direction. In other words, a consideration is taken so that the first projections 22 as well as the second projections 23 cannot be arranged continuously on a straight line parallel to the axis of the heat exchanger 2. Thus, the combustion gas passages 4 and the air passages 5 can be defined in a labyrinth-shaped configuration by the first and second projections 22 and 23 in the axially intermediate portions of the first and second heat-transfer plates S1 and S2, thereby enhancing the heat exchange efficiency.

Further, the first and second projections 22 and 23 are arranged in the angle-shaped portions at the axially opposite ends of the first and second heat-transfer plates S1 and S2 at an arrangement pitch different from that in the axially intermediate portion. In the combustion gas passage 4 shown in FIG. 3, the combustion gas flowing thereinto through the combustion gas passage inlet 11 in the direction of an arrow a is turned in the axial direction to flow in the direction of an arrow b, and is further turned in the direction of an arrow c to flow out through the combustion gas passage outlet 12. When the combustion gas changes its course in the vicinity of the combustion gas passage inlet 11, a combustion gas flow path $P_s$ is shortened on the inner side as viewed in the turning direction (on the radially outer side of the heat exchanger 2), and a combustion gas flow path $P_L$ is prolonged on the outer side as viewed in the turning direction (on the radially inner side of the heat exchanger 2). On the other hand, when the combustion gas changes its course in the vicinity of the combustion gas passage outlet 12, the combustion gas flow path $P_s$ is shortened on the inner side as viewed in the turning direction (on the radially inner side of the heat exchanger 2), and the combustion gas flow path $P_L$ is prolonged on the outer side as viewed in the turning direction (on the radially outer side of the heat exchanger 2). When a difference is produced between the lengths of the combustion gas flow paths on the inner and outer sides as viewed in the direction of turning of the combustion gas, the combustion gas flows in a drifting manner from the outer side as viewed in the turning direction toward the inner side where the flow resistance is small because of the short flow path, whereby the flow of the combustion gas is non-uniformized, resulting in a reduction in heat exchange efficiency.

Therefore, in regions $R_3$, $R_3$ in the vicinity of the combustion gas passage inlet 11 and the combustion gas passage outlet 12, the pitch of arrangement of the first projections 22 as well as the second projections 23 in the direction perpendicular to the direction of flowing of the combustion gas is varied so that it becomes gradually denser from the outer side toward the inner side as viewed in the turning direction. By non-uniformizing the pitch of arrangement of the first projections 22 as well as the second projections 23 in the regions $R_3$, $R_3$ in the above manner, the first and second projections 22 and 23 can be arranged densely on the inner side as viewed in the turning direction where the flow path resistance is small because of the short flow path of the combustion gas, whereby the flow path resistance can be increased, thereby uniformizing the flow path resistance over the entire regions $R_3$, $R_3$. Thus, the generation of the drifting flow can be prevented to avoid the reduction in heat exchange efficiency. Particularly, all the projections in a first row adjacent the inner side of the first projection stripes $\mathbf{24}_F$, $\mathbf{24}_R$ comprise the second projections 23 protruding into the combustion gas passages 4 (indicated by a mark x in FIG. 3). Therefore, a drifting flow preventing effect can effectively be exhibited by non-uniformizing the pitch of arrangement of the second projections 23.

Likewise, in the air passage 5 shown in FIG. 4, the air flowing thereinto in the direction of an arrow d through the air passage inlet 15 is turned axially to flow in the direction of an arrow e, and further turned in the direction of an arrow f to flow out through the air passage outlet 16. When the air changes its course in the vicinity of the air passage inlet 15, the air flow path is shortened on the inner side as viewed in the turning direction (on the radially outer side of the heat exchanger 2), and the air flow path is prolonged on the outer side as viewed in the turning direction (on the radially inner side of the heat exchanger 2). On the other hand, when the air changes its course in the vicinity of the air passage outlet 16, the air flow path is shortened on the inner side as viewed in the turning direction (on the radially inner side of the heat exchanger 2), and the air flow path is prolonged on the outer side as viewed in the turning direction (on the radially outer side of the heat exchanger 2). When a difference is generated between the lengths of the air flow paths on the inner and outer sides as viewed in the direction of turning of the air, the air flows in a drifting manner toward the inner side as viewed in the turning direction where the flow path resistance is smaller because of the short flow path, thereby reducing the heat exchange efficiency.

Therefore, in regions $R_4$, $R_4$ in the vicinity of the air passage inlet 15 and the air passage outlet 16, the pitch of arrangement of the first projections 22 as well as the second projections 23 in the direction perpendicular to the direction of flowing of the air is varied so that it becomes gradually denser from the outer side toward the inner side as viewed in the turning direction. By non-uniformizing the pitch of arrangement of the first projections 22 as well as the second projections 23 in the regions $R_4$, $R_4$ in the above manner, the first and second projections 22 and 23 can be arranged densely on the inner side as viewed in the turning direction where the flow path resistance is small because of the short flow path of the air, whereby the flow path resistance can be increased, thereby uniformizing the flow path resistance over the entire regions $R_4$, $R_4$. Thus, the generation of the drifting flow can be prevented to avoid the reduction in heat exchange efficiency. Particularly, all the projections in a first row adjacent the inner side of the second projection stripes $\mathbf{25}_F$, $\mathbf{25}_R$ comprise the first projections 22 protruding into the combustion gas passages 4 (indicated by a mark x in FIG. 4). Therefore, a drifting flow preventing effect can effectively be exhibited by non-uniformizing the pitch of arrangement of the first projections 22.

When the combustion gas flows in each of the regions $R_4$, $R_4$ adjacent the regions $R_3$, $R_3$ in FIG. 3, the pitch of arrangement of the first projections 22 as well as the second projections 23 in the region $R_4$, $R_4$ little exerts an influence to the flowing of the combustion gas, because the pitch is non-uniform in the direction of flowing of the combustion gas. Likewise, when the air flows in each of the regions $R_3$, $R_3$ adjacent the regions $R_4$, $R_4$ in FIG. 4, the pitch of arrangement of the first projections 22 as well as the second projections 23 in the region $R_3$, $R_3$ little exerts an influence to the flowing of the combustion gas, because the pitch is non-uniform in the direction of flowing of the air.

As can be seen from FIGS. 3 and 4, the first and second heat-transfer plates S1 and S2 are cut into an unequal-length angle shape having a long side and a short side at the front and rear ends of the heat exchanger 2. The combustion gas passage inlet 11 and the combustion gas passage outlet 12 are defined along the long sides at the front and rear ends, respectively, and the air passage inlet 15 and the air passage outlet 16 are defined along the short sides at the rear and front ends, respectively.

In this way, the combustion gas passage inlet 11 and the air passage outlet 16 are defined respectively along the two sides of the angle shape at the front end of the heat exchanger 2, and the combustion gas passage outlet 12 and the air passage inlet 15 are defined respectively along the two sides of the angle shape at the rear end of the heat exchanger 2. Therefore, larger sectional areas of the flow paths in the inlets 11, 15 and the outlets 12, 16 can be ensured to suppress the pressure loss to the minimum, as compared with a case where the inlets 11, 15 and the outlets 12, 16 are defined without cutting of the front and rear ends of the heat exchanger 2 into the angle shape. Moreover, since the inlets 11, 15 and the outlets 12, 16 are defined along the two sides of the angle shape, not only the flow paths for the combustion gas and the air flowing out of and into the combustion gas passages 4 and the air passages 5 can be smoothened to further reduce the pressure loss, but also the ducts connected to the inlets 11, 15 and the outlets 12, 16 can be disposed in the axial direction without sharp bending of the flow paths, whereby the radial dimension of the heat exchanger 2 can be reduced.

As compared with the volume flow rate of the air passed through the air passage inlet 15 and the air passage outlet 16, the volume flow rate of the combustion gas, which has been produced by burning a fuel-air mixture resulting from mixing of fuel into the air and expanded in the turbine into a dropped pressure, is larger. In the present embodiment, the unequal-length angle shape is such that the lengths of the air passage inlet 15 and the air passage outlet 16, through which the air is passed at the small volume flow rate, are short, and the lengths of the combustion gas passage inlet 11 and the combustion gas passage outlet 12, through which the combustion gas is passed at the large volume flow rate, are long. Thus, it is possible to relatively reduce the flow rate of the combustion gas to more effectively avoid the generation of a pressure loss.

As can be seen from FIGS. 3 and 4, the outer housing 9 made of stainless steel is of a double structure comprised of outer wall members 28 and 29 and inner wall members 30 and 31 to define the air introducing duct 17. A front flange 32 bonded to rear ends of the front outer and inner wall members 28 and 30 is coupled to a rear flange 33 bonded to front ends of the rear outer and inner wall members 29 and 31 by a plurality of bolts 34. At this time, an annular seal member 35 which is E-shaped in section is clamped between the front and rear flanges 32 and 33 to seal the coupled surfaces of the front and rear flanges 32 and 33, thereby preventing the air within the air introducing duct 17 from being mixed with the combustion gas within the combustion gas introducing duct 13.

The heat exchanger 2 is supported on the inner wall member 31 connected to the rear flange 33 of the outer housing 9 through a heat exchanger supporting ring 36 made of the same plate material under the trade name of "Inconel" as the heat exchanger 2. The inner wall member 31 bonded to the rear flange 33 can be considered substantially as a portion of the rear flange 33, because of its small axial dimension. Therefore, the heat exchanger supporting ring 36 can be bonded directly to the rear flange 33 in place of being bonded to the inner wall member 31. The heat exchanger supporting ring 36 is formed into a stepped shape in section and includes a first ring portion $\mathbf{36}_1$, bonded to the outer peripheral surface of the heat exchanger 2, a second ring portion $\mathbf{36}_2$ bonded to the inner peripheral surface of the inner wall member 31 and having a diameter larger than that of the first ring portion $\mathbf{36}_1$, and a connecting portion $\mathbf{36}_3$ which connects the first and second ring portions $\mathbf{36}_1$ and $\mathbf{36}_2$ to each other in an oblique direction. The combustion gas passage inlet 11 and the air passage inlet 15 are sealed from each other by the heat exchanger supporting ring 36.

The profile of temperature on the outer peripheral surface of the heat exchanger 2 is such that the temperature is lower on the side of the air passage inlet 15 (on the axially rear side) and higher on the side of the combustion gas passage inlet 11 (on the axially front side). By mounting the heat exchanger supporting ring 36 at a location closer to the air passage inlet 15 than to the combustion gas passage inlet 11, the difference between the amounts of thermal expansion of the heat exchanger 2 and the outer housing 9 can be maintained to the minimum to decrease the thermal stress. When the heat exchanger 2 and the rear flange 33 are displaced relative to each other due to the difference between the amounts of thermal expansion, such displacement can be absorbed by the resilient deformation of the heat exchanger supporting ring 36 made of plate material, thereby alleviating the thermal stress acting on the heat exchanger 2 and the outer housing 9. Particularly, since the section of the heat exchanger supporting ring 36 is formed in the stepped configuration, the folded portions thereof can easily be deformed to effectively absorb the difference between the amounts of thermal expansion.

Figure 13:
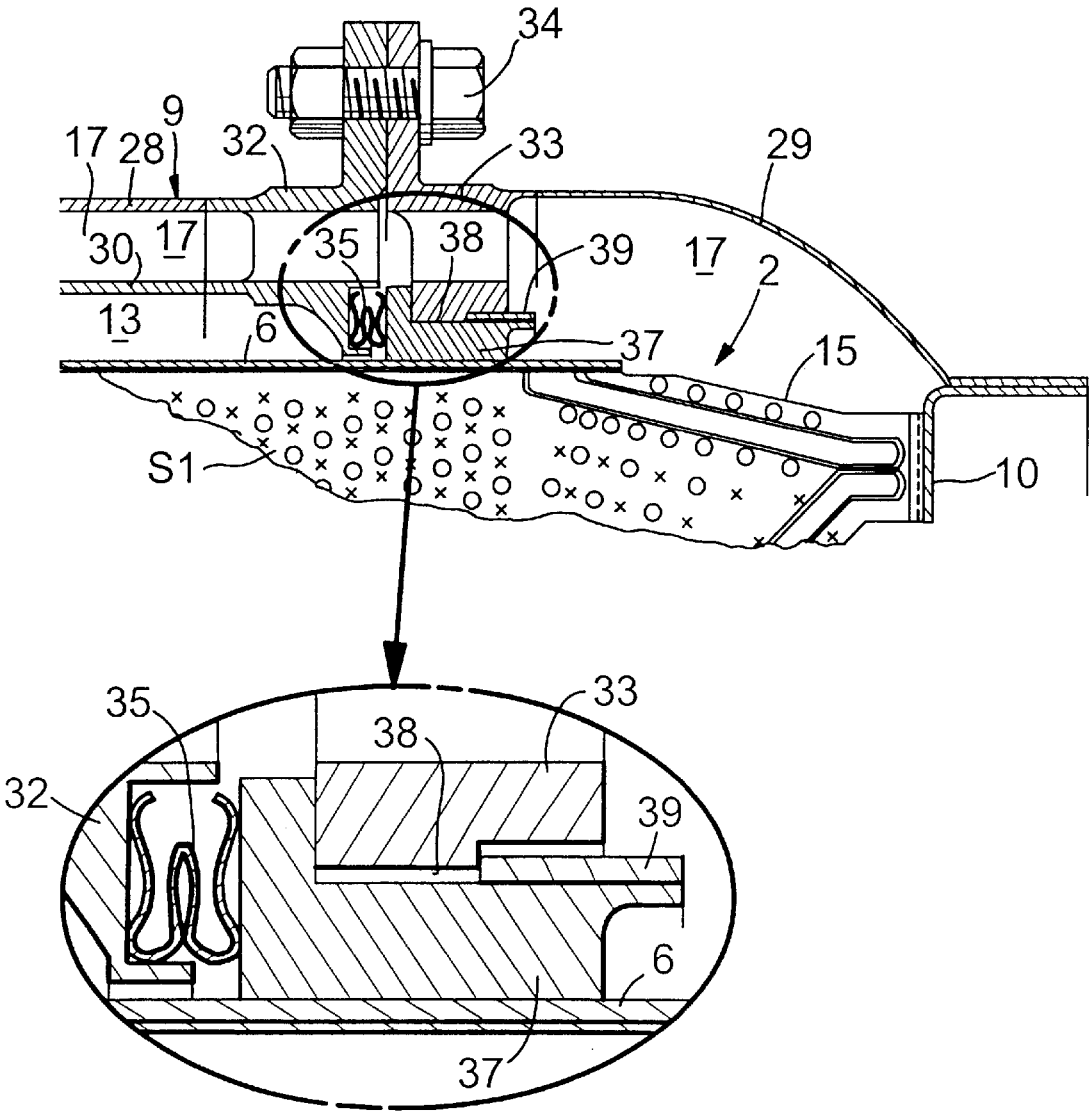
FIG. 13 is a view showing a second embodiment of the present invention.

FIG. 13 shows a second embodiment of the present invention. The second embodiment includes a heat exchanger supporting ring 37 made of Inconel and fixed to the outer peripheral surface of the heat exchanger 2 having a relative low-temperature at a location closer to a rear portion of the heat exchanger 2 (i.e., in the vicinity of the air passage inlet 15). An outer peripheral surface of the heat exchanger supporting ring 37 is fitted in a socket-and-spigot fashion at 38 to an inner peripheral surface of the rear flange 33, and a plate-shaped stopper 39 welded to a rear end of the heat exchanger supporting ring 37 is engaged with a stepped portion of the rear flange 33. During operation of the gas turbine engine E, the heat exchanger 2 intends to move forwards relative to the outer housing 9 due to a pressure differential between the high-pressure air and the low-pressure combustion gas, but the movement of the heat exchanger 2 can be inhibited by the stopper 39. Coupled surfaces of the front flange 32 and the heat exchanger supporting ring 37 are sealed by the annular seal member 35 which is E-shaped in section and hence, the mixing of the combustion gas within the combustion gas introducing duct 13 and the air within the air introducing duct 17 is prevented.

The portion 38 fitted in socket-and-spigot fashion has a radial clearance, when the heat exchanger 2 is at a low temperature in a stopped state of the gas turbine engine E. However, when the heat exchanger 2 is brought into a high temperature with operation of the gas turbine engine E, the heat exchanger 2 and the rear flange 33 is brought into a close contact with each other to eliminate the clearance due to a difference in the amount of thermal expansion between them. Thus, the heat exchanger 2 can be supported on the outer housing 9 in a stable state, while alleviating the thermal stress generated due to the difference in the amount of thermal expansion between the heat exchanger 2 and the rear flange 33.

Figure 14A:
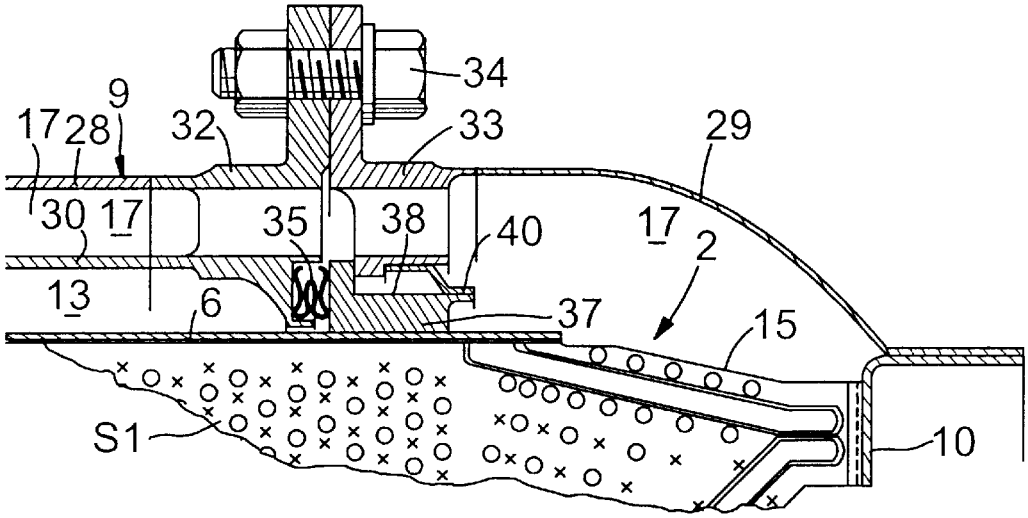
FIGS. 14A and 14B are views showing third and fourth embodiments of the present invention.
Figure 14B:
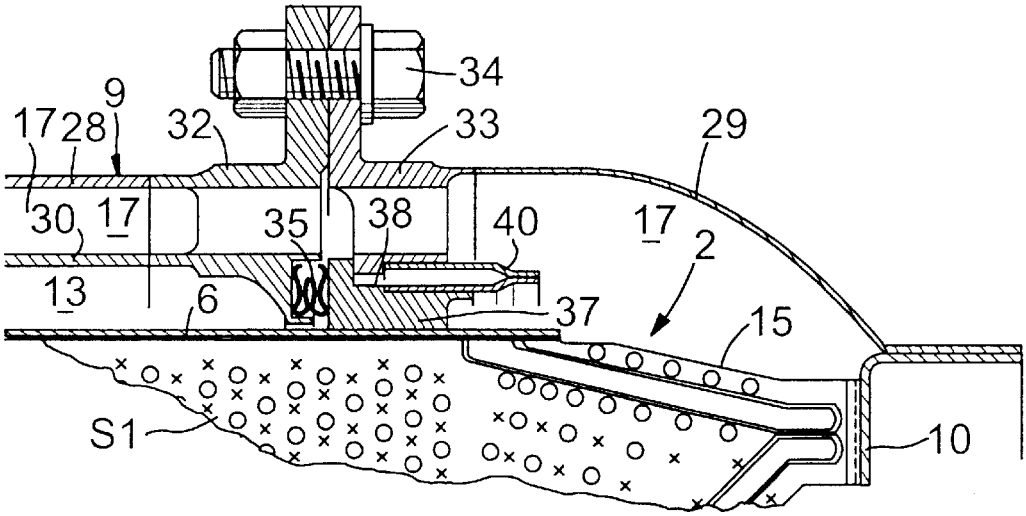

FIGS. 14A and 14B show a third embodiment and a fourth embodiment of the present invention. In the third and fourth embodiments, a clearance is provided between the outer peripheral surface of the same heat exchanger supporting ring 37 and the inner peripheral surface of the same rear flange 33 as in the second embodiment, and springs 40 fixed at one ends thereof to the heat exchanger supporting ring 37 resiliently abut at the other ends against the inner peripheral surface of the rear flange 33. By providing the plurality of springs 40 circumferentially of the heat exchanger supporting ring 37, the heat exchanger 2 can be supported on the outer housing 9 through the springs 40, and a looseness between the heat exchanger supporting ring 37 and the rear flange 33 can be prevented. Further, the heat exchanger supporting ring 37 can be prevented from being axially slipped off.

According to the third and fourth embodiments, it is possible to prevent the generation of the looseness by the resilient force of the springs 40, while absorbing the radial thermal expansion of the heat exchanger 2 by the radial clearance to alleviate the thermal stress.

Although the embodiments of the present invention have been described in detail, it will be understood that the present invention is not limited to the above-described embodiments, and various modifications in design may be made without departing from the subject matter of the present invention. For example, the heat exchanger supporting rings 36, 37 are supported on the rear flange 33 in the embodiments, but may be supported on the front flange 32. The present invention is also applicable to a heat exchanger for use in an equipment other than the gas turbine engine E.

What is claimed is:

1. A supporting structure for a heat exchanger for supporting an annular-shaped heat exchanger (2) having a high-temperature fluid passage inlet (11) at one of axially opposite ends thereof and a low-temperature fluid passage inlet (15) at the other end thereof, within a cylindrical casing (9) which is divided axially into portions bonded together through a pair of flanges (32 and 33), characterized in that a heat exchanger supporting ring (37) fixed to an outer peripheral surface of said heat exchanger (2) is fitted in a socket-and-spigot fashion (38) to an inner peripheral surface of one (33) of said flanges, and a seal member (35) is disposed between said heat exchanger supporting ring (37) and the other flange (32).

2. A supporting structure for a heat exchanger according to claim 1, characterized in that a stopper (39) is provided for preventing the slip-off of the socket-and-spigot type fitting (38).

3. A supporting structure for a heat exchanger according to either claim, characterized in that said heat exchanger supporting ring (36, 37) is mounted at a location nearer to said low-temperature fluid passage inlet (15) than to said high temperature fluid passage inlet (11).

* * * * *